US008656835B2

(12) United States Patent
Taig et al.

(10) Patent No.: US 8,656,835 B2
(45) Date of Patent: Feb. 25, 2014

(54) PRINTING DEVICE AND METHOD INCLUDING REDUCED TORQUE DISTURBANCE OF THE ROTATING COMPONENT OF THE PRINTING DEVICE

(75) Inventors: Elad Taig, Ramat Gan (IL); Haggai Abbo, Kyriat Ono (IL); Gilad Tzori, Moshav Satariyya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 739 days.

(21) Appl. No.: 12/678,481

(22) PCT Filed: Oct. 3, 2007

(86) PCT No.: PCT/US2007/080275

§ 371 (c)(1), (2), (4) Date: Apr. 29, 2010

(87) PCT Pub. No.: WO2009/045211

PCT Pub. Date: Apr. 9, 2009

(65) Prior Publication Data

US 2010/0199870 A1 Aug. 12, 2010

(51) Int. Cl.
*B65H 5/12* (2006.01)
*B41F 21/10* (2006.01)

(52) U.S. Cl.
USPC ..... 101/409; 101/246; 271/277

(58) Field of Classification Search
USPC ..... 101/409, 246; 271/277
See application file for complete search history.

(56) References Cited

U.S. PATENT DOCUMENTS

| | | | | |
|---|---|---|---|---|
| 4,390,176 | A * | 6/1983 | Kato | 271/270 |
| 4,517,575 | A * | 5/1985 | Kakimoto et al. | 346/138 |
| 5,142,305 | A * | 8/1992 | Maslanka et al. | 346/138 |
| 5,333,547 | A | 8/1994 | Pfisterer et al. | |
| 6,955,123 | B1 | 10/2005 | Kurtzer | |
| 2005/0285333 | A1 * | 12/2005 | Sting et al. | 271/277 |

FOREIGN PATENT DOCUMENTS

| | | |
|---|---|---|
| DE | 4109824 | 10/1991 |
| DE | 266764 | 2/1996 |

* cited by examiner

*Primary Examiner* — Leslie J Evanisko

(57) ABSTRACT

A printing device for printing on a printable media. The printing device comprises a rotating component (1), a gripper mechanically coupled to the rotating component (1) and configured for loading and unloading the printable media to and from the rotating component (1), an actuating element (5) configured for actuating the gripper, the actuation resulting in a disturbance to the rotation of the rotating component (1), and a compensating element (6) shaped such as to reduce the disturbance by applying a compensating mechanical force to the rotating component (1) during the rotation of the rotating component (1).

17 Claims, 7 Drawing Sheets

PRINTING DEVICE AND METHOD INCLUDING REDUCED TORQUE DISTURBANCE OF THE ROTATING COMPONENT OF THE PRINTING DEVICE

CLAIM FOR PRIORITY

The present application is a national stage filing under 35 U.S.C 371 of PCT application number PCT/US2007/080275, filed on Oct. 3, 2007, the contents of which are hereby incorporated by reference in its entirety.

FIELD AND BACKGROUND OF THE INVENTION

In most printing presses, sheet-fed rotary printing mechanisms are used. Each sheet-fed rotary printing mechanism integrates one or more rotating components, such as cylindrical sheet guides in order to process the sheets and pass them among the different assemblies of a printing press. For example, most high-speed, sheet-fed rotary printing presses are provided with an impression drum. Cylinders which permit the press to print on two sides of a sheet, and which may be used for single-sided, multi-color printing are commonly used.

In order to retain sheets on the rotating components and in order to allow the transferring of sheets to and from the rotating components, grippers are usually used. The grippers are needed in order to facilitate the loading and unloading of sheets to and from the rotating components. Transmission elements and adjusting mechanisms are usually needed in addition to the grippers in order to coordinate among the printing press assemblies during the loading and unloading of the sheets and in order to allow different movement patterns of the sheets within the printing press. A turning impression drum, for example, is usually designed with spaces to receive grippers and transmission elements and has a cylindrical sheet support surface that is operative to guide the sheets, which extends over more than half the surface of the turning impression drum.

A common rotating component, such as an impression drum, is rotated by a drive unit having a motive mechanical force, such as an electric motor. Usually, the motive mechanical force actuates a drive shaft that supports and rotates the rotating component. As described above, the rotating component usually uses grippers for facilitating the loading and unloading of sheets. Usually, the drive unit or an additional drive unit supports an opening and closing of the grippers. The opening and closing change the position of the grippers in relation to the main body of the rotating component, with the result that the mass distribution of the rotating component is changed. One inherent property of such changes is load imbalance. Even a very small imbalance in the otherwise symmetrical mass distribution about the drive shaft may cause bending vibrations thereto and to the rotating component it supports. The rotating component is subjected to changes in the mass distribution during the actuation of the grippers. These changes increase the load imbalance and cause the rotating component to be subjected to disruptive mechanical forces, such as retroactive torque effect.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE EMBODIMENTS

The present embodiments comprise a printing device, such as a printing press, that has a rotating component, such as a cylindrical sheet guide, with one or more grippers for controlling the loading and unloading of sheets thereto and therefrom. The printing device further comprises an actuating element, such as a rotary cam, for actuating the grippers. The actuation of the grippers during the rotation of the rotating component may apply a disruptive mechanical force that may cause torque disturbances to the rotating component, as described above. The printing press further comprises a mechanism for reducing or eliminating the torque disturbances by applying a compensating mechanical force. In one embodiment, the grippers are mechanically coupled to the rotating component, optionally at an outer edge thereof and actuated by the actuating element, for example by changing the elevation thereof in relation to the rotating component. The mechanism for reducing torque disturbance comprises a compensating element, such as a cam, that imposes a compensating mechanical force on the rotating component during the actuating of the grippers. As further described below, the compensating element shaped such as to reduce the disturbance by applying a compensating mechanical force to the rotating component during the actuating of the grippers.

The present embodiments further comprise a method for reducing or eliminating torque disturbances from a rotating component, thereby optionally reducing rotationally induced vibrations therefrom.

The principles and operation of an apparatus and method according to the present invention may be better understood with reference to the drawings and accompanying description.

Figure 1:
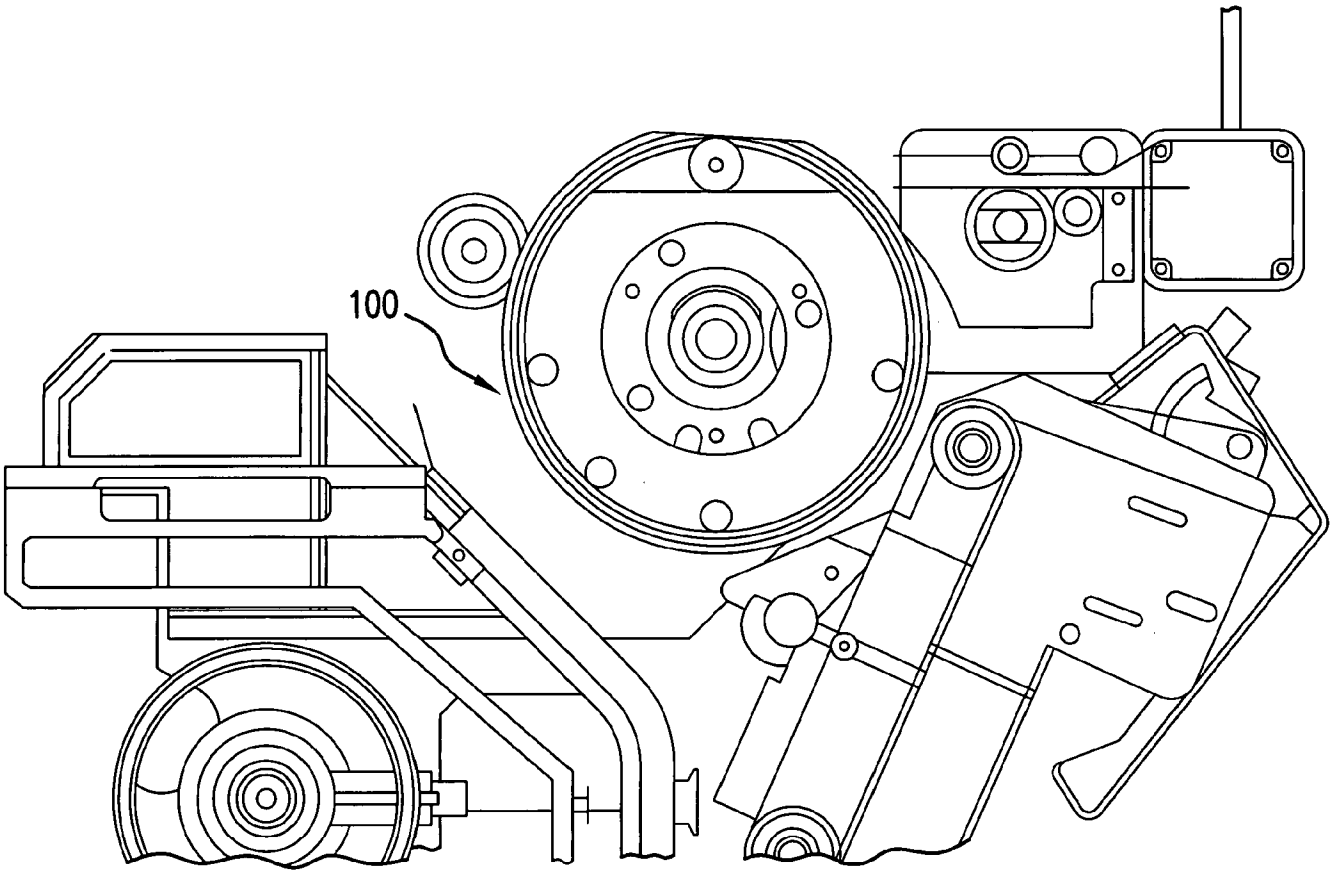
FIG. 1 is a sectional view of a printing press that comprises a rotating component, according to one embodiment of the present invention.

Reference is now made to FIG. 1, which is a sectional view of a printing press having a rotating component 1, according to one embodiment. Though the rotating component 1, which is depicted in FIG. 1, is an impression drum that is used for printing on a printable media which rotate thereon, such as a sheet or a web, the embodiments may be related to other rotating components such as a cylindrical sheet guide, a rolling mill, or a roller of a rotary printing press or another machine, such as, a treatment or a processing machine for webs and sheets. In an advantageous manner, the present invention may also be applied to rollers and cylinders of similar machinery for producing web-shaped materials, such as paper, textile, sheet metal, and the like.

A gripper system is used, inter alia, for retaining sheets on the impression drum 1 and for transferring documents between the impression drum 1 and other assemblies of the printing press. Examples of such printing presses are those currently manufactured by Hewlett-Packard Development Company, L.P., under the designations "HP Indigo press 3050," "HP Indigo press 1050" and "HP Indigo press s2000."

In between each one of the grippers and the impression drum 1, there is a sheet holding space. The width of the space is determined by the proximity of the gripper to the outer surface of the impression drum 1. In use, a sheet is fed towards the impression drum 1, and is held in place by grippers. As the impression drum rotates, an image is printed on the sheet. Other drums such as a storage drum or a perfecting cylinder may be used as well. In order to ensure proper feeding of the sheet, the opening and closing operations of the grippers are synchronized with the rotation of the impression drum 1.

Figure 2:
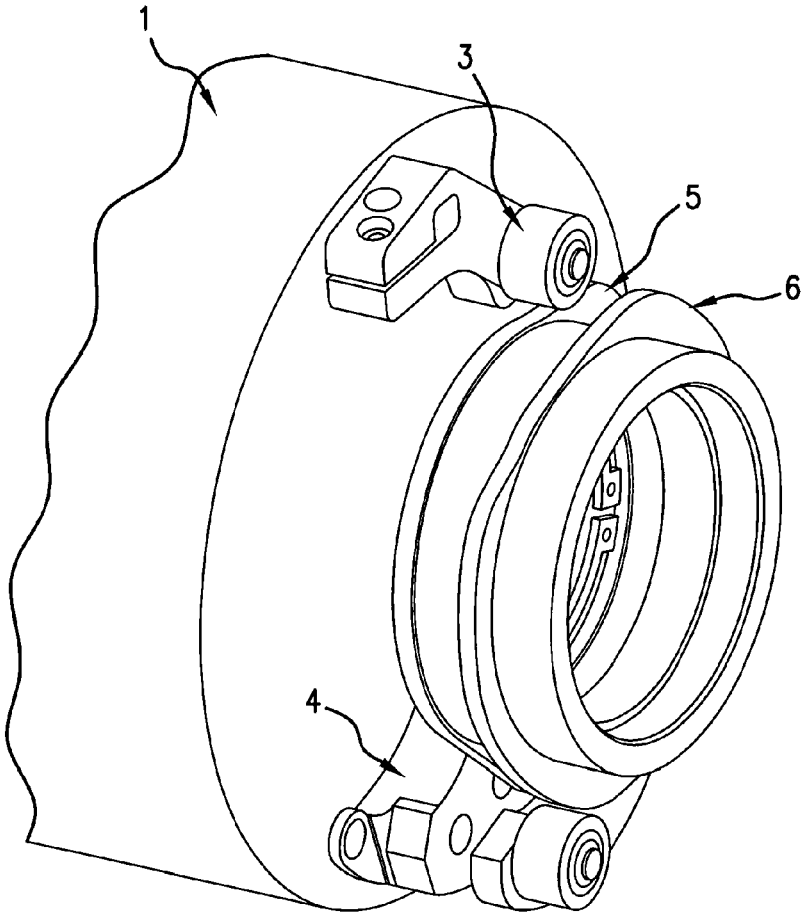
FIG. 2 is a schematic illustration of a lateral edge of a rotating component, according to one embodiment of the present invention.

Reference is now made to FIG. 2, which is a schematic illustration of the lateral edge of the rotating component, according to one embodiment. The rotating component 1 is attached with grippers (not shown). As described above, the gripper system is used, inter alia, for retaining sheets or the like on the rotating component 1 and for transferring documents between the rotating component 1 and other assemblies of the printing press.

In order to feed the sheet, the gripper, which are attached to the rotating component 1, are opened and closed during the rotation of the rotating component 1. Optionally, the gripper is mechanically coupled to a gripper follower 3 that transfers a mechanical force that opens the grippers during the rotation of the rotating component 1.

An exemplary description of a gripper system and the synchronization of the opening and closing thereof with the rotation of the cylindrical sheet guide 1 are provided in U.S. patent application Ser. No. 11/543,577, filed on Oct. 5, 2006, which is incorporated herein by reference. It should be noted that though only one gripper 2 is depicted in FIG. 2, a number of grippers 2 may be mechanically coupled to the rotating component 1.

The gripper system of the rotating component 1 comprises an actuating element 5, such as a rotary cam, that may be understood as a primary cam, for controlling the elevation of the gripper 2 during the printing process, as described above and in U.S. patent application Ser. No. 11/543,577. As described above, the rotating component 1 is subjected to changes in the mass distribution during the actuation of the gripper 2. The opening and closing change the position of the grippers 2 in relation to the main body of the rotating component 1 results in changes to the mass distribution of the rotating component 1 and applies disruptive mechanical force, such as a mechanical torque. One inherent property of such changes is load imbalance. Even a very small imbalance in the otherwise symmetrical mass distribution about the drive shaft may cause bending vibrations thereto and to the rotating component 1 it supports. These changes increase the load imbalance and cause torque disturbances. It should be noted that the load imbalance increases as the rotational speed of the rotating component increases. Such a load imbalance causes vibrations that may lead to banding and streak-type artifacts, may increase the likelihood of jams and smearing, may reduce the registration quality of the printing press, and may increase the banding on the printed sheets.

The gripper system further comprises a compensating element 6, which may be referred to as an anti-cam, such as an additional rotary cam, for imposing a compensating mechanical force on the rotating component 1 during the actuating of the gripper 2. The compensating element 6 is shaped to counteract or substantially counteract the disturbance caused by the actuation of the grippers. Optionally, the rotating component 1 is mechanically coupled with a compensating follower 4, which may be understood as a dummy follower that transfers the compensating mechanical force, such as a mechanical torque, from the compensating element 6 thereto.

Optionally, the compensating and the actuating elements 5, 6 are cams, such as rotary cams, which are mounted on a common axle (not shown). In some embodiments, the compensating cam 6 applies to the rotating component, a compensating mechanical torque that causes its torque to have a phase, which is opposite to the phase of the torque of the rotating component 1 during the actuation of the grippers.

In optional embodiments, the compensating cam 6 applies to the rotating component, a compensating mechanical force that causes its torque to have a phase, which is opposite to the phase of the torque of the rotating component 1 during the actuation of the grippers. Optionally, the compensating cam 6 applies to the rotating component, a compensating mechanical force that causes its torque to have amplitude, which is similar to the amplitude of the torque of the rotating component 1 during the actuation of the grippers. In such a manner, the compensating mechanical force reduces or cancels the disturbance that is cause by the actuation of the grippers.

Figure 3A:
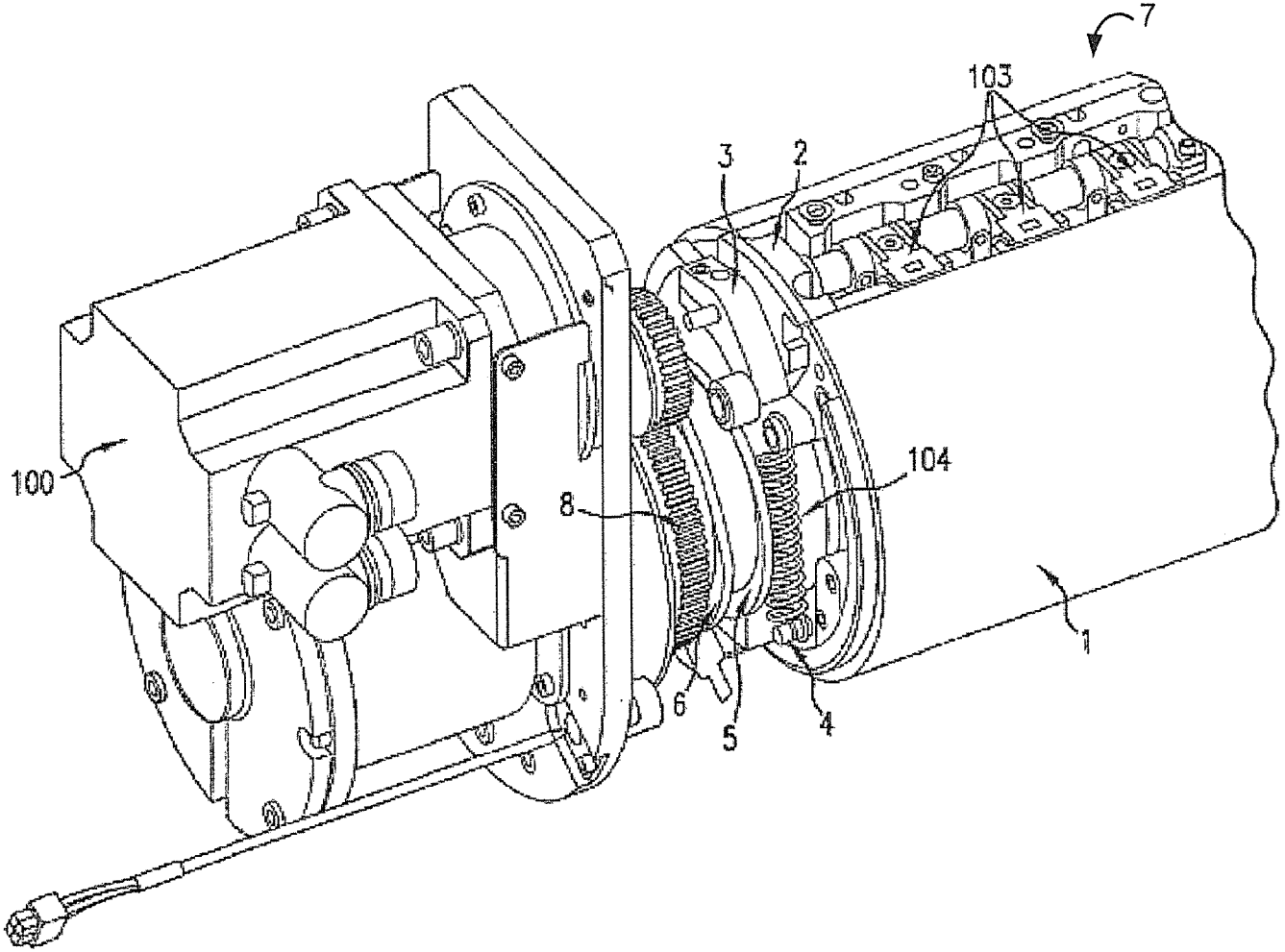
FIGS. 3A and 3B are a schematic illustration of a rotating component with a gripper system, such as an impression drum, from two respective different sides, according to one embodiment of the present invention.
Figure 3B:
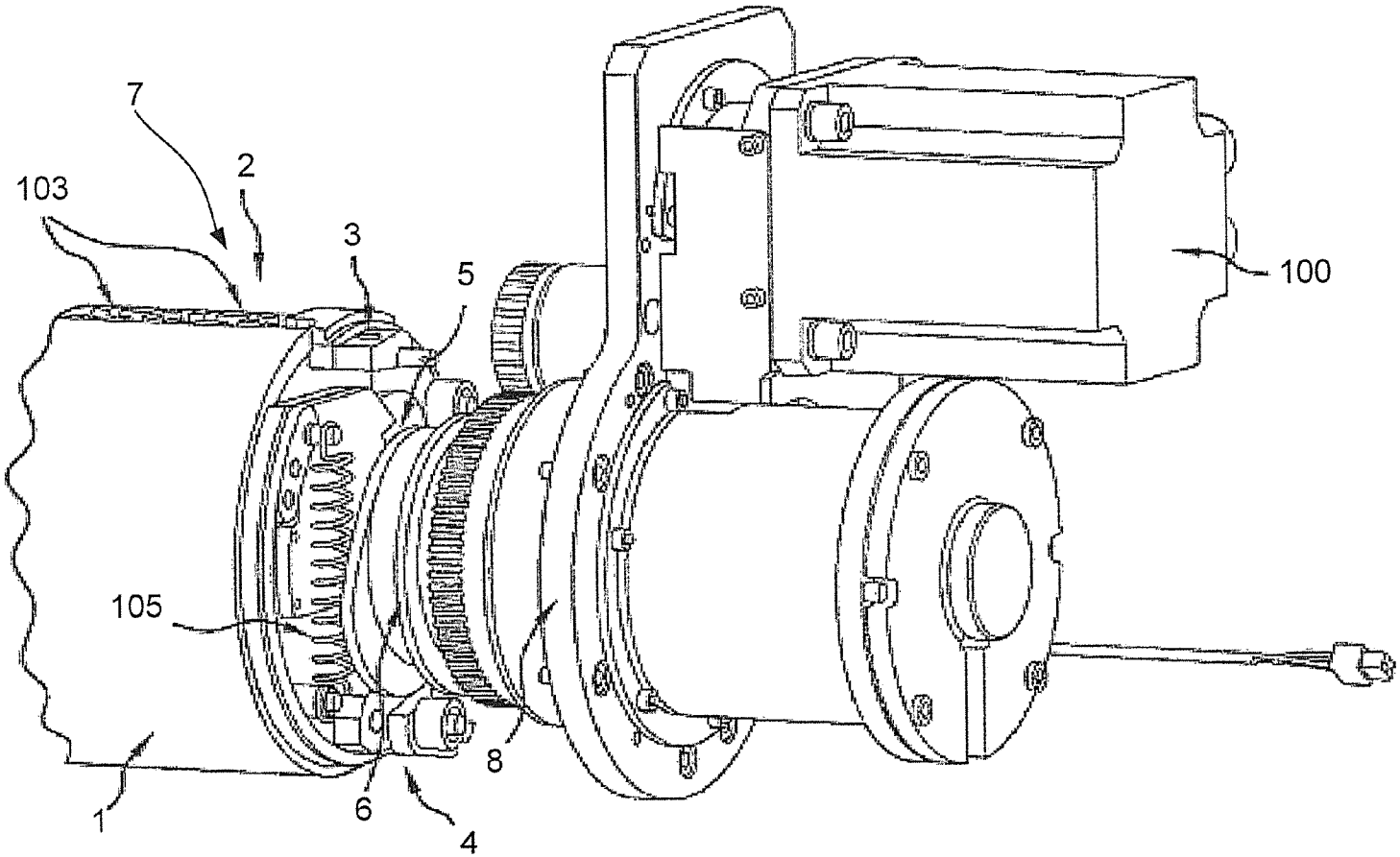

Reference is now made to FIGS. 3A and 3B, which are a schematic illustration of the rotating component 1 with a gripper system 7, such as an impression drum, from two different sides, according to one embodiment. As described above, the cam gripper system 7 comprises several parts. One component is a gripper-driving device 100, such as a servomotor, which is coupled to a stationary printing press and having an axle that is coupled to a gear-wheel (not shown). The gear-wheel is meshed with an additional gear-wheel, such that rotations of the additional gear-wheel rotates an axle 8 on which the actuating and compensating elements 6, 5 are mounted, as described above.

Optionally, the actuating element 5, which is optionally a rotary cam, is designed to be detachably coupled with the actuating cam follower 3 that is connected to the gripper 2 of the rotating component 1. The gripper 2 comprises one or more blades 103, which firmly retain a sheet against the rotating component 1 during the printing process. The actuating cam follower 3 maneuvers the gripper 2, therewith change the opening height that is formed in between the gripper blades 103 and the rotating component 1. Individual grippers or groups of grippers on the edge of the rotating component 1 are actuated either independently of one another, or simultaneously by the actuating cam 5.

Optionally, the compensating element 6, which is optionally a rotary cam, is designed to be detachably coupled with a compensating cam follower 4, which may be understood as a dummy cam follower that is attached to the rotating component 1, optionally on the lateral side thereof. As described above, the elevation of the gripper 2 by the actuating element 5 changes the position of the grippers in relation to the main body of the rotating component, with the result that the mass distribution of the rotating component is changed. Such a change in the mass distribution radially causes torque disturbance, inter alia, as the speed of the rotation of the rotating component increases. The compensating element 6 is designed to apply compensating mechanical force on the rotating component 1 whenever it makes contact therewith, typically through a mechanical interface, such as a cam follower, that is connected thereto. Optionally, the compensating element 6 applies the compensating mechanical force on the compensating cam follower 4, which is attached to the rotating component 1, and thereby reduces or eliminates the torque disturbance that is caused by the actuating of the grippers.

Optionally, the actuating and the compensating cam followers 3, 4 are positioned at opposite sides of the axle 8, for example as depicted in FIGS. 3A and 3B.

Figure 4:
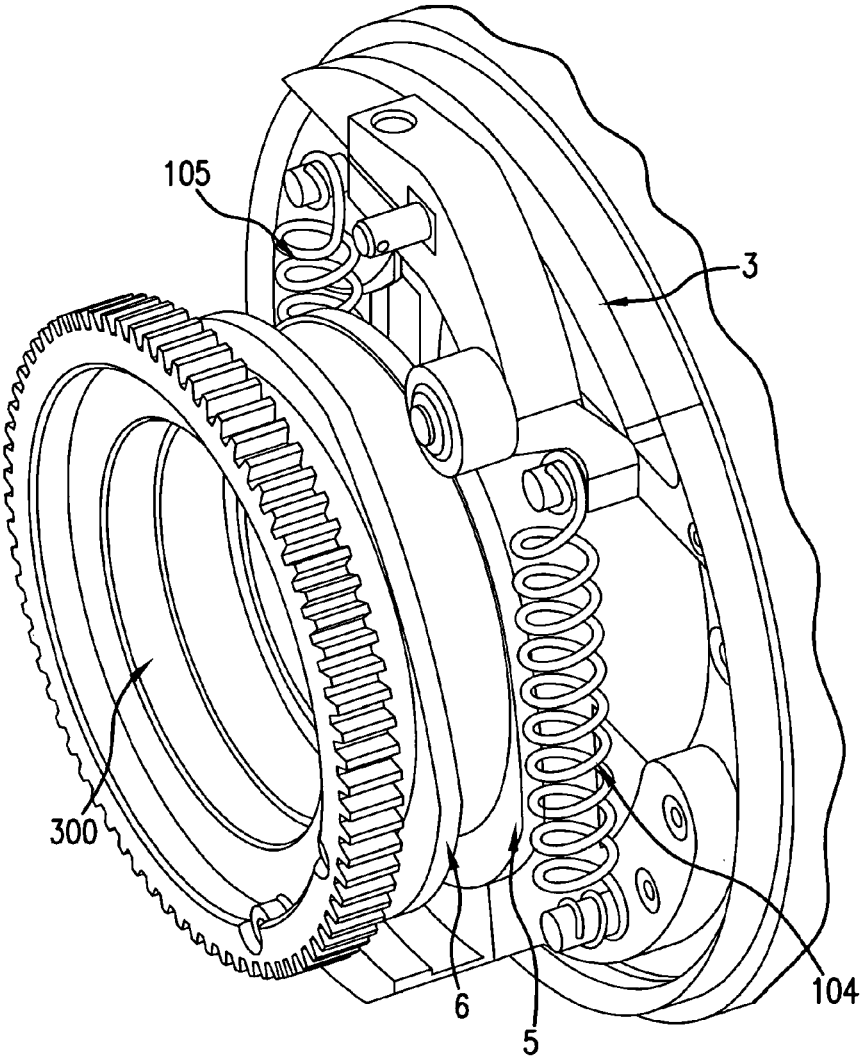
FIG. 4 is a schematic illustration of a hub that holds a compensating cam and an actuating cam thereon, according to an embodiment of present invention.

In one embodiment, the compensating and actuating elements 5, 6 are mounted on a common hub that is situated around the axle 8. FIG. 4 depicts a schematic illustration of an exemplary hub 300 that hosts the compensating and the actuating elements 5, 6.

In use, the compensating and the actuating elements 5, 6 are designed to make contact with the compensating and the actuating cam followers 4, 3 at the same time. The contact between the compensating element 6 and the compensating cam follower 4 reduces or eliminates the torque disturbance that is caused by the actuation of the grippers to the rotating component 1. In such a manner, as described above, the banding and registration artifacts, which are caused by the opening and closing of the gripper 2, are reduced.

In one embodiment, a follower return spring is used for returning the actuating cam follower 3, the compensating cam follower 4, or both, as shown at 104 and 105, to their former positions after the compensating cam 6, the actuating cam 5, or both have moved them. Each one of the follower return springs 104, 105 applies tension to the respective follower 5, 4 and therefore has an effect on the torque and the compensating which the actuating cam 5 and the compensating cam 6 apply.

In one embodiment, the compensating cam 6 is defined according to the profile of the actuating cam 5. The actuating cam 5 has a predefined profile. The relative rotational motion between the rotation of the rotating component 1, which may be an impression drum, and the actuating cam 5 causes a change in the elevation of the cam follower 3 and the attached grippers 2 according to the profile of the actuating cam 5. For example, when the cam follower 3 touches the lowered surface of the actuating cam 5, the gripper is closed; when it touches the average elevated of the actuating cam 5, the gripper is partially open; and when it touches the highly elevated surface of the cam, the gripper is fully open. Such a profile allows predefining the exact elevation of the grippers 2 relative to any rotational position of the rotating component 1.

Optionally, in order to calculate the profile of the compensating cam 6, the final profile of the actuating cam 5 is taken. Then, the torque of the rotating component during the actuation of the grippers by the actuating cam 5 is identified. The torque is optionally calculated when the actuating cam 5 is static and/or dynamic in relation the rotating component 1. An initial design of the profile of the compensating cam 6, and of the tension, which is applied by the follower return spring 105, is calculated using the identified torque that has been measured and/or calculated during the actuation of the one or more grippers by the actuating cam 5. Optionally, the identified torque is based on the phase of the identified torque. Optionally, the calculation process is iterative.

In one embodiment, the gripper system 7 and the compensating and the actuating elements 5, 6 are positioned within the rotating component 1. Such an embodiment reduces the probability that a certain sheet may become entangled with parts of the gripper system.

The gripper system comprises several different parts. In the present embodiment, the actuating element 5, the compensating element 6, or both are linear cams, which are used in order to control the direction and magnitude of the linear motion of the followers. Unlike rotary cams, a linear cam moves backwards and forwards. A linear cam has a flat plate cam profile, which engages the cam follower. The shape of the profile determines the degree of elevation of the follower. Optionally, in order to actuate the linear cams, linear actuators are used. An exemplary description of a gripper system with a linear cam and a linear actuator is provided in U.S. patent application Ser. No. 11/543,577, filed on Oct. 5, 2006, which is incorporated herein by reference.

In one embodiment, the gripper-driving device 100 is a pneumatic actuator, such as a servo-pneumatic actuator. Unlike other gripper-driving device 100, such as a servomotor that generates rotational propulsion, the pneumatic actuator generates linear propulsion. Such an embodiment reduces the probability that a certain sheet may become entangled with parts of the gripper system, since the linear cams are usually provided in a closed housing. It should be noted that the linear motion of the linear cam may cause substantially less jarring of the system than does the rotational motion of the rotary cam.

Figure 5:
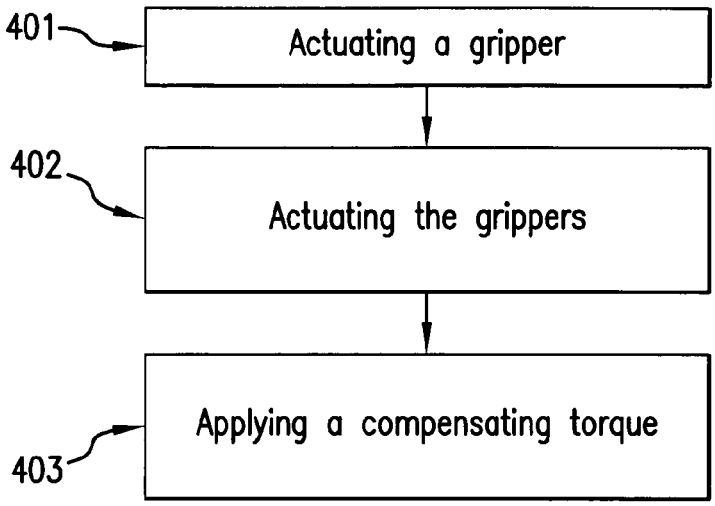
FIG. 5 is a schematic illustration of a flowchart of a method for reducing torque disturbance in a rotating component having gripper, according to an embodiment of the present invention.

Reference is now made to FIG. 5, which is a flowchart that illustrates a method for reducing torque disturbance in a rotating component having gripper, according to an embodiment. First, as shown at 401, one or more grippers of the rotating component are actuated during the rotation of the rotating component 1. The actuation of the grippers, as described above, allows the loading and unloading of sheets to and from the rotating component 1. As shown at 402 and described above, the actuation of the grippers causes a disturbance to the rotating component. There may also be additional torque due to friction with the actuated gripper elements of the rotating component. The disturbance causes the rotational component to have a torque in a certain phase, which is an outcome of the friction between the actuating element, which is optionally a cam, and the grippers of the rotating component or a mechanical interface that is coupled to the grippers, such as a follower, optionally a cam follower. Then, during the actuation of the grippers, a compensating mechanical force that causes the rotational component to have a torque, which is opposite to the phase of the aforementioned mechanical force, is applied, as shown at 403, to the rotating component 1. The compensating mechanical force reduces or eliminates the torque disturbances of the rotating component 1.

Additional objects, advantages, and novel features of the foregoing will become apparent to one ordinarily skilled in the art upon examination of the following examples, which are not intended to be limiting. Additionally, each of the various embodiments and aspects of the foregoing and as claimed in the claims section below finds experimental support in the following examples.

Figure 6:
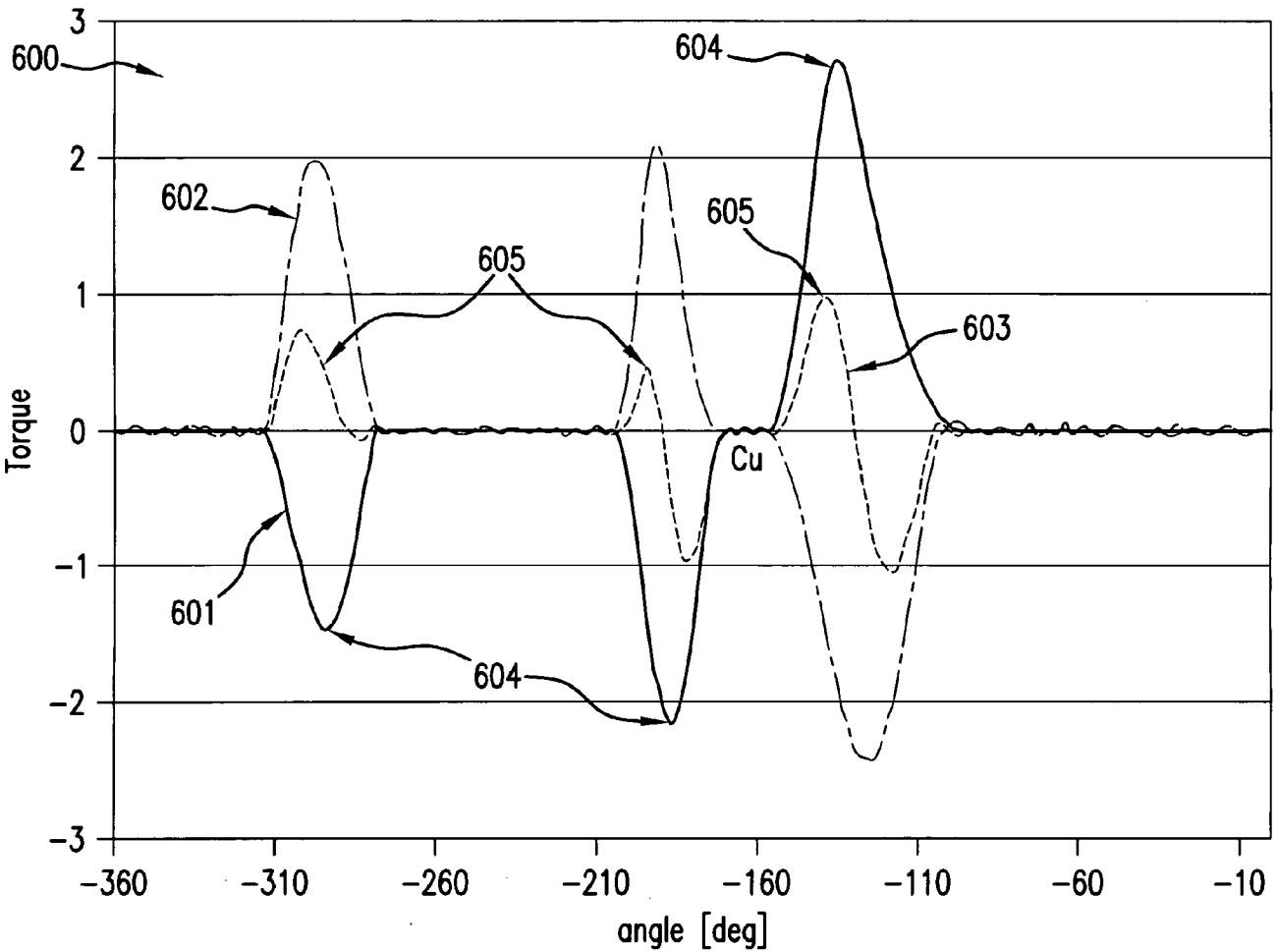
FIG. 6 is a graph that depicts a simulation of a mechanical force that is applied to a motor that actuates the cams of the gripper system, in accordance with an embodiment of the present invention.

Reference is now made to FIG. 6, which is a graph 600 that depicts a simulation of the torques, which are imposed by the actuating and compensating cams on an impression drum, according to one embodiment.

The graph simulates the mechanical force that is applied to the motor that actuates the cams. The Y-axis of the graph 600 denotes the energy expended by the motor in newton-meter (Nm) units, which is the torque force that is imposed by the cams on the impression drum, and the X-axis of the graph 600 denotes the rotational angle of an actuating cam and/or a compensating cam in relation to the rotational angle of the impression drum.

Curve 601 simulates the torque force that is imposed on the impression drum as a result of the operation of the actuating cam. Curve 602 simulates the torque force that is imposed on the impression drum as a result of the operation of the compensating cam. Curve 603 simulates of the residual torque force that is imposed on the impression drum as a result of the operation of the actuating cam and the compensating cam simultaneously, as described above.

As shown in FIG. 6, curves 601, 602 are inverted to one another. As described above, the torque disturbance that is caused by the actuating of the gripper by the cam, for example as depicted by curve 601, is compensated by the compensating mechanical force that is applied to the impression drum by the compensating cam, for example as depicted by curve 602. As depicted in the graph 600, the torque disturbances, which are applied on the impression drum during the actuation of the grippers 604, are substantially reduced by the operation of the compensating cam 605.

It is expected that during the life of this patent many relevant devices and systems will be developed and the scope of the terms herein, particularly of the terms circuitry, printing press, and impression drum is intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present subject matter.

What is claimed is:

1. A printing device for printing on a printable media, comprising:

a rotating component comprising an axle and a rotating drum portion;

a gripper disposed on said rotating drum portion of said rotating component to load and unload the printable media to and from said rotating component;

an actuating element to perform an actuation of said gripper to result in a disturbance to a rotation of said rotating component;

a compensating follower attached to said rotating drum portion of said rotating component; and a compensating element to mechanically couple with said compensating follower during said actuation to reduce said disturbance, said compensating element to apply a compensating mechanical force to said rotating drum portion of said rotating component during said actuation.

2. The printing device of claim 1, wherein said gripper comprises a plurality of gripper elements.

3. The printing device of claim 1, wherein said compensating element is shaped to reduce said disturbance to about zero.

4. The printing device of claim 1, wherein each said actuating element and compensating element comprises a rotary cam, a linear cam, or a linear actuator.

5. The printing device of claim 1, wherein each said actuating element and compensating element is actuated by a servomotor or a linear actuator.

6. The printing device of claim 1, wherein said actuating element and compensating element are mounted on a common shaft.

7. The printing device of claim 1, wherein said actuating element and compensating element are mounted on a common hub, said common hub being situated on a shaft.

8. The printing device of claim 1, wherein said gripper is mechanically coupled at an outer edge of said rotating drum portion of said rotating component.

9. The printing device of claim 1, wherein said compensating element is shaped such as to reduce rotationally induced vibrations of said rotating component.

10. The printing device of claim 1, wherein said gripper is coupled to at least one actuating cam follower, said actuation being performed by moving said at least one actuating cam follower.

11. The printing device of claim 1, wherein during said actuation, said rotating component has a first torque component in a first torque phase, said compensating mechanical force to cause said rotating component to have a second torque component in an approximately opposite torque phase to said first torque phase.

12. The printing device of claim 11, wherein said first and second torque components have approximately a same amplitude.

13. The printing device of claim 1, wherein said compensating element is to apply said compensating mechanical force, and said actuating element is to actuate said gripper, simultaneously.

14. The printing device of claim 1, wherein said compensating follower is attached to a lateral side of at least one end of opposing ends of the rotating drum portion of the rotating component.

15. A method for guiding a printable media in a printing device, the printing device comprising a rotating component comprising an axle and a rotating drum portion; a gripper disposed on said rotating drum portion of said rotating component to load and unload the printable media to and from said rotating component; an actuating element; a compensating element; and a compensating follower attached to said rotating drum portion of said rotating component, the method comprising:

actuating the gripper of the rotating drum portion using said actuating element during a rotation of the rotating component, the rotating component having a first torque in a first phase during said actuating; and applying a compensating mechanical force from said compensating element to said compensating follower of said rotating drum portion during said rotation, said compensating mechanical force to apply a second torque in a second phase during a rotation of the rotating component, said first and second phases being opposite to one another;

wherein said actuating and applying are performed simultaneously.

16. The method of claim 15, wherein said first and second torques have approximately the same amplitude.

17. The method of claim 15, wherein said applying reduces rotationally induced vibrations of said rotating component.

* * * * *